US008212672B2

(12) United States Patent
Brenner

(10) Patent No.: US 8,212,672 B2
(45) Date of Patent: Jul. 3, 2012

(54) METHOD AND DEVICE FOR PROTECTING ARTICLES

(75) Inventor: Rainer Brenner, Teningen-Kondringen (DE)

(73) Assignee: Checkpoint Systems, Inc., Thorofare, NJ (US)

( * ) Notice: Subject to any disclaimer, the term of this patent is extended or adjusted under 35 U.S.C. 154(b) by 900 days.

(21) Appl. No.: 12/064,026

(22) PCT Filed: Aug. 16, 2006

(86) PCT No.: PCT/EP2006/008083

§ 371 (c)(1),
(2), (4) Date: Sep. 23, 2008

(87) PCT Pub. No.: WO2007/020071

PCT Pub. Date: Feb. 22, 2007

(65) Prior Publication Data

US 2009/0051535 A1 Feb. 26, 2009

(30) Foreign Application Priority Data

Aug. 17, 2005 (DE) ..... 10 2005 038 811

(51) Int. Cl.
*G08B 13/14* (2006.01)

(52) U.S. Cl. ..... 340/571; 340/572.1; 340/568.8; 340/568.1

(58) Field of Classification Search ..... 340/571
See application file for complete search history.

(56) References Cited

U.S. PATENT DOCUMENTS

| | | | | |
|---|---|---|---|---|
| 5,552,771 | A | 9/1996 | Leyden et al. | |
| RE37,590 | E | 3/2002 | Leyden et al. | |
| 6,578,683 | B1 | 6/2003 | Burke et al. | |
| 6,659,382 | B2 | 12/2003 | Ryczek | |
| 6,690,277 | B1 | 2/2004 | Hansen et al. | |
| 6,700,488 | B1 | 3/2004 | Leyden et al. | |
| 6,799,994 | B2 | 10/2004 | Burke | |
| 6,828,909 | B2 | 12/2004 | Script et al. | |
| 6,879,961 | B1 | 4/2005 | Pathirana | |
| 6,896,543 | B2 * | 5/2005 | Fort et al. | 439/501 |
| 6,946,961 | B2 | 9/2005 | Frederiksen et al. | |
| 6,989,748 | B2 * | 1/2006 | Rabanne et al. | 340/572.1 |
| 7,002,467 | B2 | 2/2006 | Deconinck et al. | |
| 7,021,091 | B2 | 4/2006 | Leyden et al. | |
| 7,042,360 | B2 * | 5/2006 | Light et al. | 340/572.1 |

(Continued)

FOREIGN PATENT DOCUMENTS

| | | |
|---|---|---|
| CA | 2096603 | 11/1994 |

(Continued)

*Primary Examiner* — George Bugg
*Assistant Examiner* — Kerri McNallly
(74) *Attorney, Agent, or Firm* — Sand & Sebolt

(57) ABSTRACT

The invention relates to a device (1) for protecting articles (2), especially displayed goods, from theft. Said device comprises a sensor, connected to a control and alarm device (4) for triggering an alarm when the sensor (3) responds, and to be secured to the article (2) to be protected. The device (1) also comprises a device for detecting if a person gets closer to the displayed article (2) or when the article (2) is removed but not taken. For this purpose, a sensor (7) responds when a person gets closer or when the article (2) is removed and is control-connected to the control and alarm device (4). The control and alarm device (4) is connected to a product information device (13) for presenting the displayed article (2).

24 Claims, 2 Drawing Sheets

U.S. PATENT DOCUMENTS

| | | | | |
|---|---|---|---|---|
| 7,053,774 | B2 | 5/2006 | Sedon et al. | |
| 7,081,822 | B2 | 7/2006 | Leyden et al. | |
| 7,132,952 | B2 | 11/2006 | Leyden et al. | |
| 7,135,972 | B2 | 11/2006 | Bonato | |
| 7,154,039 | B1 | 12/2006 | Marszalek et al. | |
| 7,202,417 | B2 | 4/2007 | Marszalek et al. | |
| 7,202,786 | B2 | 4/2007 | Marszalek et al. | |
| 7,204,107 | B2 | 4/2007 | Leyden et al. | |
| 7,209,038 | B1 | 4/2007 | Deconinck et al. | |
| 7,327,276 | B1 * | 2/2008 | Deconinck et al. | 340/687 |
| 7,397,372 | B2 * | 7/2008 | Perri et al. | 340/572.1 |
| 2005/0012613 | A1 * | 1/2005 | Eckstein et al. | 340/539.13 |
| 2005/0128083 | A1 * | 6/2005 | Puzio et al. | 340/572.1 |
| 2005/0220439 | A1 * | 10/2005 | Carton et al. | 386/4 |
| 2006/0097875 | A1 * | 5/2006 | Ott | 340/572.1 |

FOREIGN PATENT DOCUMENTS

| | | | |
|---|---|---|---|
| DE | 19528178 | A1 | 2/1997 |
| DE | 19726413A1 | | 1/1999 |
| DE | 10250004 | | 5/2004 |
| DE | 10250339 | A1 | 5/2004 |
| DE | 202005015472 | U1 | 1/2006 |
| DE | 202005016161 | U1 | 2/2006 |
| DE | 102004053426 | | 5/2006 |
| EP | 1030284 | | 8/2000 |
| EP | 1417912 | | 5/2004 |
| GB | 2355565 | | 4/2001 |
| JP | 2001-243564 | | 9/2001 |
| JP | 2005-309521 | | 11/2005 |
| WO | 02/090693 | | 11/2002 |

* cited by examiner

METHOD AND DEVICE FOR PROTECTING ARTICLES

CROSS-REFERENCE TO RELATED APPLICATIONS

This national stage application claims the benefit under 35 U.S.C. §371 of International Application No. PCT/EP2006/008083 filed on Aug. 16, 2006, entitled METHOD AND DEVICE FOR PROTECTING ARTICLES, which in turn takes its priority from German Application No. 10 2005 038 811.6 filed on Aug. 17, 2005, and all of whose entire disclosures are incorporated by reference herein.

BACKGROUND OF THE INVENTION

1. Field of Invention

This invention relates to a method for the securing of objects, in particular of items of merchandise put on display, wherein an alarm is produced when the object is stolen. Furthermore, the present invention relates to an apparatus for implementing the method, wherein for the protection of objects against theft, including in particular items of merchandise put on display, provision is made for a sensor that is adapted to be affixed to the object to be secured and is connected to a checking and alarm device for activating an alarm on response of the sensor.

2. Description of Related Art

The surveillance of freely presented objects to protect them against theft by means of a sensor that is connected to a checking and alarm device via a current line is known in the art. When the line or the antitheft installation is manipulated or the sensor is removed, the checking and alarm device sets off an audible and visual alarm.

Moreover, sales-promoting systems are known using, for example, end-less-loop audiovisual advertising. They suffer however from the disadvantage of not allowing perfectly timed advertising relating to a particular product and geared to the specific information needs, accordingly resulting in high coverage losses.

SUMMARY OF THE INVENTION

It is an object of the present invention to provide a method and an apparatus of the type initially referred to, which enables specific, product-related advertising while at the same time providing for reliable surveillance of the displayed object and requiring a comparatively small outlay particularly in equipment and installation.

To accomplish this object, with regard to the method of the invention it is proposed that, apart from an alarm being set off when the object is stolen, a logging function is performed when a person approaches the object or removes the object without taking it away, and at least one action is started with the logging, which action includes at least a product information about the object being displayed.

With regard to the apparatus it is proposed that it include a logging device performing a logging function when a person approaches the object on display or removes the object without taking it away, that to this effect a sensor be provided that responds when a person approaches or removes the object and is in controlling communication with the checking and alarm device, and that the checking and alarm device be connected to a product information device for presenting the displayed object.

By reason of the logging using an additional logging sensor operable on a person's approaching or removing the object connected to the checking and alarm device already provided as antitheft device, it is possible to attract a prospective customer's/viewer's interest in simple manner by presenting, for example, the function of the exhibit. Considering that essential components of the antitheft device, which generally is already provided, can be shared, a simple and economical system expansion is possible by adding the product information as a supplementary function.

Preferably, the product information about the object on display is by audiovisual devices, since this allows a comprehensive information in a particularly intensive, fast and effective way. The audiovisual product information may be output preferably by means of a product information device including a video data base with an in particular digital player and a connected visual display unit for visual display and, as the case may be, a loudspeaker and/or headset for listening.

Typically, a free presentation includes a plurality of objects. When, as a further action, events are counted and/or date and/or time of the day are saved, the detections may be stored with date and time of the day for later reference in statistical analyses in order to obtain information about the attractiveness of the object put on display. For this purpose, the checking and alarm device includes a storage memory for storing the event count and/or date and/or time of the event.

In the absence of a current event being detected, no product-related promotion will be shown, instead general advertising may be shown in the mean-time. This may include manufacturer advertising of the displayed object or market advertising. These advertising periods as well as the aforementioned statistical data obtained may be evaluated and/or sold to the manufacturers, for example.

Particularly electronic products in the fields of information technology and audio/video equipment are as a rule freely presented in substantial quantities. When a theft alarm is set off, it is therefore difficult to be able to locate the site of the theft promptly.

Therefore, it may be useful when, in the case of a theft, an audible alarm is set off and an at least visual alarm concerning the object to be secured is produced by the device provided for audiovisual product information.

In the case of a theft alarm it is thus possible to output on the visual display unit associated with the stolen object a product-related alarm notification, thereby enabling the site of the theft to be located promptly.

Using the same infrastructure, it is hence possible to place the freely presented objects under surveillance, allowing a fast, product-related visualization of the alarm on the one hand and promotion of the objects on the other hand, which results in significant cost reductions in investment and the obtainment/sale of statistical data.

It is also worth mentioning that the logging sensor is also capable of tripping further promotional actions including, for example, actions that also address the other sense organs, such as scents, wind and the like.

The sensor of the logging device may be a motion sensor. It operates to start the product information when a prospective buyer approaches or stands in front of the product on display. No additional action is required in this case.

However, the possibility also exists for the sensor of the logging device to be a removal sensor. In this event the product information is not started until the prospective buyer takes the product in his hand, showing an apparent interest in it. False activations as may be caused by a passing customer are thereby avoided.

In either event, the product information is activated when the prospective buyer is within a predetermined range in the region of the displayed product.

The sensor may also be used as a special proximity sensor for distance measurement. This distance sensor is arranged in the proximity of the displayed object to be secured and detects the distance between it and an object to be secured or a person approaching it.

Among other things, the measured distance may be evaluated for a signaling function, where appropriate, with activation of a product-related information and/or an early warning and a theft warning. When the product is removed and kept within a distance of, for example, 2 m, a logging signal may be issued, for example, by activation of an orange LED light in order to indicate to the user that his action is recorded. Should he move away from the distance sensor together with the product by a distance of more than two meters, for example, this would be interpreted as theft, and an alarm would be triggered.

When a person approaches the displayed object, the product information is started, where appropriate together with the early warning. The proximity sensor may also be configured such as to respond when the displayed object is touched. Accordingly, an action may be released on approaching, removing or touching the displayed object.

The sensor of the logging device may also be a switch, in particular a mechanical or capacitive or inductive or optoelectronic or magnetic switch.

Particularly advantageously, the sensor of the logging device is part of the antipilferage sensor arrangement, because this enables multiple use to be made of existing equipment.

In a preferred embodiment, the antipilferage sensor arrangement may include a sensor affixed to the object to be secured, which sensor is connected to the checking and alarm device through a cable wound on a cable retractor, with the sensor of the logging device being configured to detect when the wound-up cable is being pulled off the cable retractor. The cable retractor provides for a "tidy" presentation.

The sensor may be configured as a magnetic switch comprising a reed contact mounted on the enclosure of the cable retractor and a magnet fitted to the pull-out type cable.

In this arrangement it is suitable for the magnet fitted to the cable to be constructed as a cable stop resting against an abutment with the cable in roughly wound-up condition.

Such a sensor arrangement affords, inter alia, the advantage of being retrofittable with ease.

While the apparatus of the invention and the related method are primarily concerned with the securing of items of merchandise, they may also find utility in exhibitions, galleries, for example, to provide the viewer with explanations/information, and, on the other hand, in the securing of the exhibits, such as paintings, against theft. The theft detection sensor may be affixed preferably to the frame or the like, while the logging sensor is preferably a motion sensor that, on recording a viewer's presence, starts the output of information.

The present invention with its essential details will be described in more detail in the following with reference to two embodiments. In the drawings showing in a somewhat schematic view,

DETAILED DESCRIPTION OF THE PREFERRED EMBODIMENT

Figure 1:
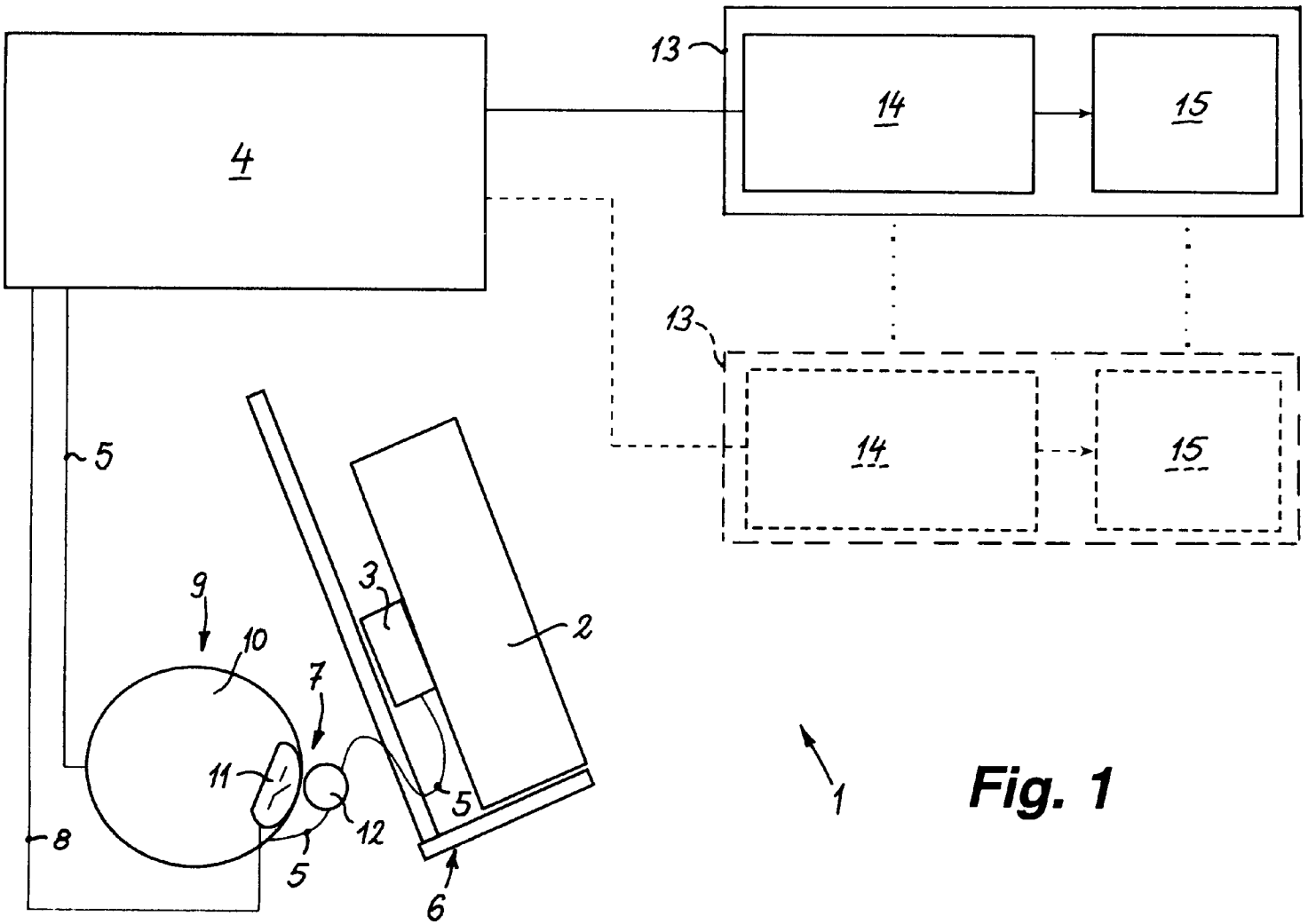
FIG. 1 is an apparatus for protection against theft as well as for the automatic output of product information.

An apparatus 1 shown in FIG. 1 serves the dual purpose of protecting items of merchandise put on display or objects 2 against theft and performing a logging function when a person approaches the object 2 or removes the object without taking it away. When a logging function is performed, at least one action, namely a product information about the object on display, is started.

The objects 2, which include cell phones, for example, are freely accessible to the prospective buyer in one or several display shelves 6. Depending on the configuration of the apparatus 1, up to 250 items may be subjected to surveillance and presented by audiovisual devices.

The apparatus 1 includes a theft detection sensor 3 that is affixed to the object 2 to be secured and is connected to a checking and alarm device 4 by means of a cable 5. When the sensor 3 responds when removed from the object 2 or when the cable 5 is severed/manipulated, a theft alarm will be produced.

When a person approaches or removes the object 2 on display, this will be recorded by a logging device, the ensuing action then being an audiovisual product information. In the embodiment shown, the logging device includes a removal sensor 7 which is in controlling communication with the checking and alarm device 4 provided as antitheft device via a cable 8, so that both functions require only one shared checking and alarm device.

The cable 5 connected to the theft detection sensor 3 is wound on a cable retractor 9.

The removal sensor 7 is configured to detect when the wound up cable 5 is being unwound from the cable retractor 9.

In the embodiment shown the sensor 7 is constructed as a magnetic switch having a reed contact 11 fitted to the cable retractor enclosure 10 as well as a magnet 12 fitted to the pull-out type cable 5.

The reed contact is preferably embedded in plastic and may be mounted on or in the cable retractor enclosure 10. Aside from its function as a permanent magnet for switching the reed contact as soon as the magnet leaves its position of rest when the cable is pulled out, causing the magnetic field at the reed contact to be interrupted, the magnet 12 has the added function of a cable stop for pull-relief of the cable 5 and the connected sensor 3 in the rest position. In this arrangement, the magnet 12 affixed to the cable 5 functions as a cable stop, resting in roughly wound-up condition of the cable 5 against an abutment defined by the enclosure 10 in this embodiment.

It is particularly advantageous in this arrangement for the sensor 7 (event sensor) to be retrofittable easily, to be a low-cost and sturdy item and to require little space.

For presenting the objects 2 put on display, product information devices 13 are in controlling communication with the checking and alarm device 4. The product information device 13 contains a function block 14 with a video data base and a digital player as well as a visual display unit 15. The dashed line indicates that plural, for example, ten, product information devices 13 may be connected to the checking and alarm device 4.

Depending on which removal sensor 7 was activated, the associated product information is retrieved from the video data base and shown on the visual display unit 15.

A product information device 13 may be assigned to single objects 2 or a plurality, particularly a group, of similar objects on display. How many objects 2 are allocated to a product information device 13 depends, inter alia, on the object size.

For example, 25 exhibits 2 may share one product information device 13 with a video data base and a digital player as well as a visual display unit 15.

The modular design enables the apparatus 1 to be configured individually in conformity with the given conditions. Thus, an existing apparatus for theft detection is readily extendable and with relatively little effort to include one or plural product information devices 13 and one or plural removal sensors 7, providing a system enabling the output of specific product information. On the other hand, the product information device 13 or several such devices may also be used as standalone with one or several removal sensors 7.

Figure 2:
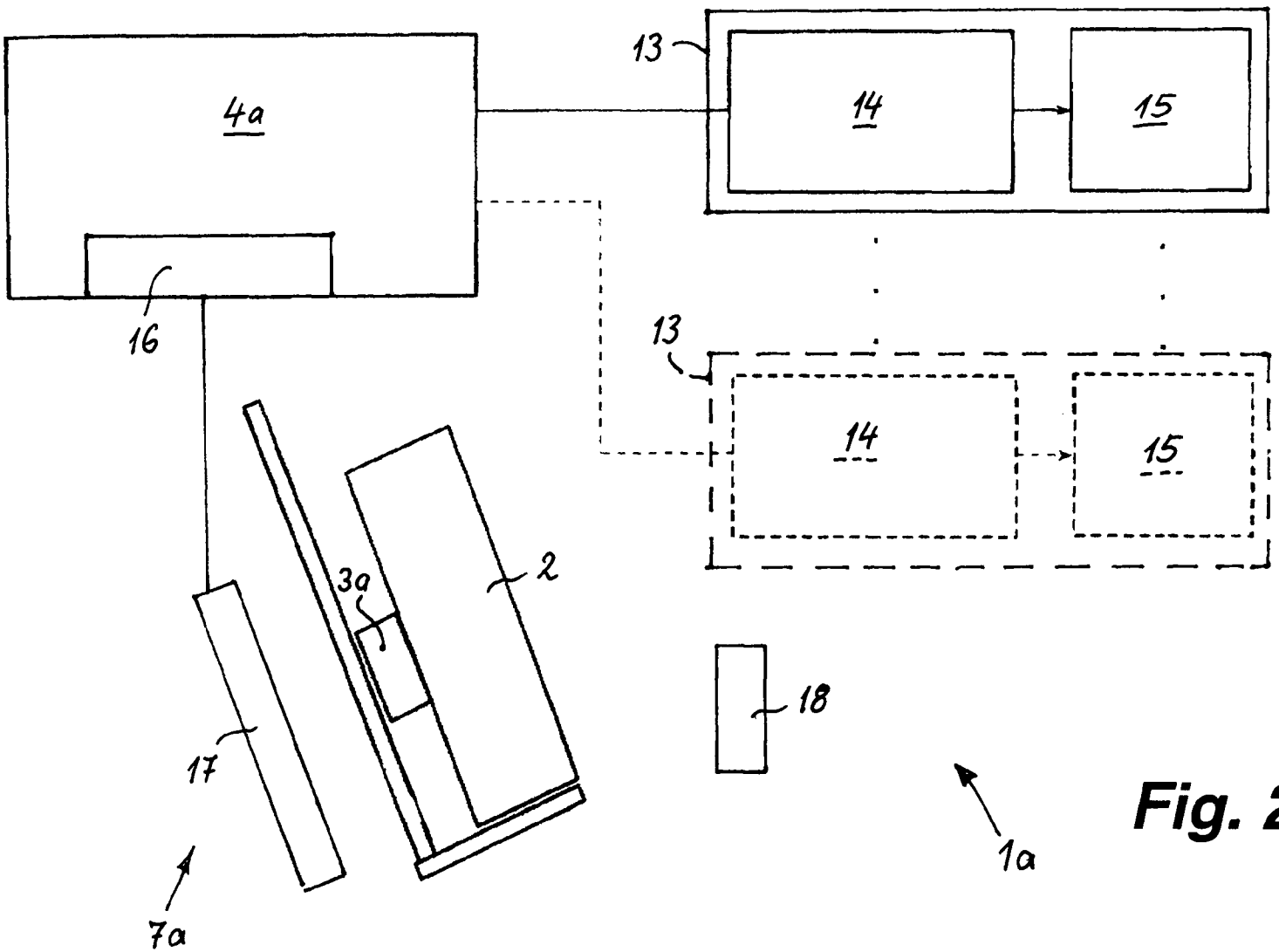
FIG. 2 is an apparatus similar to the one of FIG. 1 but including a distance sensor.

FIG. 2 shows in a further embodiment an apparatus 1*a* in which a proximity sensor is constructed as a distance sensor 7*a*.

In the embodiment shown, the distance sensor 7*a* includes an antenna 17 or similar detecting element which is connected to a receiver 16 preferably integrated into the checking and alarm device 4*a*. The antenna 17 is arranged behind the object 2 to be secured and/or also behind the display shelf 6.

The distance sensor 7*a* serves to detect the relative distance of a person and/or the object 2 to be secured and/or a sensor 3*a* affixed to the object 2 to be secured to the antenna 17 of the distance sensor 7*a*.

In combination with the distance sensor 7*a*, the checking and alarm device 4*a* may be configured and/or adjustable to produce a signal when the object 2 to be secured is approached, touched or moved within a predeterminable removal distance, and to set off a theft alarm when this removal distance is exceeded.

In the embodiment, a sensor 3*a* is affixed to the object 2 to be secured, said sensor including a transmitter and at least digital/analog inputs in particular for microswitches or for a safety film for article surveillance as well as for battery monitoring of a supply battery.

The distance sensor 7*a* responds also when a person approaches the antenna 17, whose operating range may be two meters, for example. It is able to detect whether a person approaches this antenna 17, which is assigned to a displayed object 2, and to what distance.

In addition, this distance sensor 7*a* also detects through the antenna 17 the distance between the product 2 equipped with the sensor 3*a* and the antenna 17. Hence it can be established whether the product was removed from the shelf 6 and how far away from its original location. For example, this enables a logging signal to be issued to inform the user that his action is recorded. In particular when the proximity sensor or distance sensor 7*a* responds, a product-related promotion and information function is started for the customer. When the object 2 is carried farther away from its original location, then a theft alarm may be set off.

Where appropriate, added provision may be made for tracking the removed object 2 within the premises, with corresponding signaling. During tracking the sensor 3*a* has a function comparable to a transponder chip (RFID) otherwise affixed to the product.

Furthermore, the distance sensor 7*a* may detect through the antenna 17 whether an approaching person is authorized to manipulate the apparatus. Such persons carry an electronic key 18 which transmits corresponding ID data to the antenna 17 and hence to the receiver 16 or the checking device 4*a*. Thus a wireless authorization check with in particular capacitive transmission takes place.

The possibility also exists for the distance sensor 7*a* to include several antennae 17 at one site subject to surveillance, which antennae are arranged such that, inter alia, also the direction in which the object 2 to be secured is removed is detectable. It is also possible to arrange several antennae at predetermined distances, spacing them, for example, at 5-meter distances within the market or similar premises, thus enabling the product to be tracked on the premises.

Several distance sensors 7*a* may be connected to the checking and alarm device 4*a*, whereby one receiver 16 may have connected to it several antennae 17, each assigned to one surveillance site.

It is noted that for proximity and/or contact sensing use may also be made of the conductivity of the skin and an electrostatic near-field wherein information transfer is possible via the skin and, on the other hand, the variation of an electric field by a human being is detectable.

In this arrangement, for example, a transmitter integrated into the electronic key 18 (FIG. 2) may be used for producing the electrostatic field and couple its signal into a person's skin, which also functions without direct skin contact. By modulating data onto the signal voltage spreading over the entire skin surface, information items may be transmitted as, for example, for identification purposes.

In practice, the following construction is possible:

On an active data transmission through the skin, small transmitters carried close to the human body produce an electric field through which coded information items, coupled directly or capacitively, can be transmitted to one or several receivers. In this way, the information transmitted may identify an object or a person.

However, such signals can be received only if objects equipped with transmitters are in close proximity to the human body. Switching operations can then be released promptly. However, this process may also be reversed. When these objects are removed, causing the transmission to be aborted, a prompt switching operation can equally take place.

It is also possible to detect the variation of an electric field by an approaching person or a person who is within the range of the electrostatic field, hence detecting passively the presence of a body as it comes closer and using this condition to trigger an action, for example, a product information.

In contrast to the active transmission of signals, the passive detection of a body approaching does not involve an identification function.

When, for example, a sensor 3*a* with a transmitter is affixed to the object 2 to be secured, it is possible to detect a theft of the object 2 taken by the thief, because the transmitter affixed to the object 2 couples its signal into the person's skin surface, producing an electrostatic field in the process. Through receivers which may be distributed to various locations in a market, this field can be received and evaluated, hence enabling the stolen object to be tracked.

Accordingly, when the proximity sensor 7 and/or the sensor 3 affixed to the object 2 to the be secured is equipped with a transmitter, an electrostatic field can be generated which can be put to various uses. As described in the foregoing, the electrostatic field can be coupled into a person's skin surface and used, for example, for the transmission of data. On the other hand, an evaluation of the variation of the electrostatic field by an approaching person can also be used for triggering an action.

The invention claimed is:

1. A method for promoting an object positioned at a location of the object while securing it from theft, said method comprising:

performing a logging function when a person approaches the object at its location or manipulates the object while remaining within a predetermined distance from the location;

providing product information to the person upon the person approaching the object or manipulating the object;

setting off an alarm if the object is moved beyond said predetermined distance; and wherein said step of performing a logging function comprises performing a wireless authorization check on persons approaching the object.

2. The method as claimed in claim 1, wherein said step of providing product information comprises providing an audiovisual display of product information about the object.

3. The method as claimed in claim 2 wherein said step of setting off an alarm comprises activating an audible alarm and wherein a visual alarm is provided by said audiovisual display.

4. The method as claimed in claim 1 wherein said step of performing a logging function comprises counting events or saving the date and time of an event.

5. The method as claimed in claim 1 wherein said logging function comprises:

measuring the distance between a distance sensor arranged in the proximity of the object and the object or an approaching person to form a measurement result, and evaluating the measurement result to determine whether to provide product information or to activate an alarm.

6. The method as claimed in claim 1 wherein said step of performing a logging function comprises: detecting and tracking respective locations of the object within predeterminable spaces in the event that the object is being stolen.

7. The method as claimed in claim 1, object further comprising:

determining a warning distance that is less than the predetermined distance from the location of the object;

detecting when the object is moved beyond the warning distance; and generating a warning signal that the object has been moved beyond the warning distance when the person is not an authorized person.

8. An apparatus for promoting an object positioned at a location while securing the object from theft, said apparatus comprising:

an object sensor affixed to the object and wherein said object sensor is connected to a checking and alarm device, wherein the checking and alarm device generates an alarm when the object sensor is removed from the object;

a logging device performing a logging function when a person approaches the object or manipulates the object, said logging device comprising a logging sensor that detects when a person approaches or manipulates the object and is in communication with said checking and alarm device and wherein said checking and alarm device is connected to a product information device for promoting the object;

wherein said logging sensor of said logging device is a proximity sensor configured to detect a relative distance of a person to the said object sensor affixed to the object or to detect a distance between the person and the logging sensor; and wherein said proximity sensor is constructed to receive authorization data from an electronic key available to operating staff.

9. The apparatus as claimed in claim 8 wherein said product information device comprises a digital video disc including a visual display unit connected thereto for visual display and further comprising a loudspeaker or headset for listening.

10. The apparatus as claimed in claim 8 wherein said product information device is assigned to a plurality of similar objects on display.

11. The apparatus as claimed in claim 8 wherein said checking and alarm device includes a storage memory for storing an event count or the date or the time of day of an event.

12. The apparatus as claimed in claim 8 said logging sensor of the logging device is a motion sensor.

13. The apparatus as claimed in claim 8 said logging sensor of the logging device is a removal sensor.

14. The apparatus as claimed in claim 8 said logging sensor of the logging device is part of an antipilferage sensor arrangement.

15. The apparatus as claimed in claim 14 said antipilferage sensor arrangement includes a third sensor affixed to the object, said third sensor being connected to said checking and alarm device through a cable wound on a cable retractor, and wherein said logging sensor of said logging device is configured to detect when the wound-up cable is being pulled out of the cable retractor.

16. The apparatus as claimed in claim 8 wherein said logging sensor of said logging device comprises a mechanical switch or a capacitive switch or an inductive switch or an optoelectronic switch or a magnetic switch.

17. The apparatus as claimed in claim 16 wherein said magnetic switch comprises a reed contact mounted on an enclosure of a cable retractor and a magnet fitted to a pull-out type cable.

18. The apparatus as claimed in claim 17 wherein said magnet fitted to the cable functions as a cable stop that rests against an abutment with the cable in a roughly wound-up condition.

19. The apparatus as claimed in claim 8 wherein said logging sensor of said logging device is a proximity sensor configured to detect a relative distance of a person to the said object sensor affixed to the object or to detect a distance between the person and the logging sensor.

20. The apparatus as claimed in claim 19, wherein said proximity sensor includes at least one antenna which is connected to a receiver integrated into said checking and alarm device.

21. The apparatus as claimed in claim 19, wherein said proximity sensor is arranged behind the object.

22. The apparatus as claimed in claim 19 wherein said proximity sensor or said object sensor affixed to the object includes a transmitter, either for producing an electrostatic field and for coupling of the electrostatic field to a person's skin surface, or for evaluating the variation of the electrostatic field by an approaching person.

23. The apparatus as claimed in claim 8 wherein said object sensor affixed to the object includes at least one transmitter and may also include digital/analog inputs for microswitches or for a safety film for article surveillance as well as for battery monitoring of a supply battery.

24. An apparatus for promoting an object positioned at a location while securing the object from theft, said apparatus comprising:

an object sensor affixed to the object and wherein said object sensor is connected to a checking and alarm device, wherein the checking and alarm device sets off an alarm when the object sensor is removed from the object;

a logging device performing a logging function when a person approaches the object or manipulates the object, said logging device comprising a logging sensor that detects when a person approaches or manipulates the object and is in communication with said checking and alarm device and wherein said checking and alarm device is connected to a product information device for promoting the object;

wherein said logging sensor of said logging device is a proximity sensor configured to detect a relative distance of a person to the said object sensor affixed to the object or to detect a distance between the person and the logging sensor; and wherein said proximity sensor or said object sensor affixed to the object includes a transmitter, either for producing an electrostatic field and for coupling of the electrostatic field to a person's skin surface, or for evaluating the variation of the electrostatic field by an approaching person.

* * * * *